US007437977B2

(12) United States Patent
Hsieh

(10) Patent No.: US 7,437,977 B2
(45) Date of Patent: Oct. 21, 2008

(54) HAND TOOL HAVING A LARGER OPERATION ZONE

(76) Inventor: Chih-Ching Hsieh, No. 367, Pei Yang Road, Feng Yuan, Taichung Hsien (TW)

( * ) Notice: Subject to any disclaimer, the term of this patent is extended or adjusted under 35 U.S.C. 154(b) by 0 days.

(21) Appl. No.: 11/710,055

(22) Filed: Feb. 23, 2007

(65) Prior Publication Data

US 2007/0144311 A1 Jun. 28, 2007

Related U.S. Application Data

(63) Continuation-in-part of application No. 10/643,481, filed on Aug. 15, 2003, now abandoned.

(51) Int. Cl.
*B25B 13/06* (2006.01)
*B25B 13/46* (2006.01)

(52) U.S. Cl. ..... 81/124.6; 81/124.3

(58) Field of Classification Search ..... 81/124.6, 81/121.1, 119, 124.2, 124.3, 124.7; 411/402, 411/403

See application file for complete search history.

(56) References Cited

U.S. PATENT DOCUMENTS

| | | | | | |
|---|---|---|---|---|---|
| 3,273,430 | A * | 9/1966 | Knudsen et al. | ..... | 81/124.6 |
| 3,354,757 | A * | 11/1967 | Grimm et al. | ..... | 81/176.1 |
| 3,763,725 | A * | 10/1973 | Reiland | ..... | 81/124.6 |
| 4,100,824 | A * | 7/1978 | Marschke | ..... | 81/124.6 |
| 4,930,378 | A * | 6/1990 | Colvin | ..... | 81/121.1 |
| 5,295,422 | A * | 3/1994 | Chow | ..... | 81/124.3 |

* cited by examiner

*Primary Examiner*—D. S Meislin
(74) *Attorney, Agent, or Firm*—Ming Chow; Sinorica, LLC

(57) ABSTRACT

A hand tool comprises a main body provided with a mounting portion including a plurality of arcuate protruding faces and a plurality of receiving recesses located between the protruding faces. Each of the receiving recesses of the mounting portion has an arc-shaped corner. A first distance is defined to be a distance between two walls of each recess.he two wall facing to each other. A second distance is defined to be a distance from a top to a bottom of each arcuate protruding face and a third distance D is defined to be a distance between two ends of a bottom side of the arcuate protruding face. A proportion of the first distance to the second distance is 1:1.6 and a proportion of the third distance to the second distance is 1:1.5.

3 Claims, 7 Drawing Sheets

HAND TOOL HAVING A LARGER OPERATION ZONE

The invention is a continuation in part of the U.S. patent application Ser. No. 10/643,481 which is assigned and invented by the inventor of the present invention. The application is filed at Aug. 15, 2003, which is now abandoned. Thus the contents of the U.S. patent application Ser. No. 10/643,481 is incorporated into a part of the present invention.

BACKGROUND OF THE INVENTION

1. Field of the Invention

The present invention relates to a hand tool, such as a wrench, socket or the like, and more particularly to a hand tool having a larger operation zone to prevent slip of the workpiece.

2. Description of the Related Art

A conventional hand tool, such as a wrench, in accordance with the prior art shown in FIG. 9 comprises a mounting portion 61 including a plurality of arcuate protruding faces 62 and a plurality of receiving recesses 63 located between the protruding faces 62. In practice, each of the protruding faces 62 of the mounting portion 61 is rested on the flattened face 65 of the nut 64 to prevent slip of the nut 64.

However, each of the receiving recesses 63 has a corner 630 having a substantially right angle, so that the stress is easily concentrated on the corner 630, thereby breaking the structure of the wrench. In addition, the right-angled corner 630 is not easily manufactured during the working process. Further, the proportion of the depth T of each of the protruding faces 62 and the distance between the corner 630 of each of the receiving recesses 63 and the corner 630 of an adjacent receiving recess 63 is about 1:2, so that each of the protruding faces 62 has a smaller depth. Thus, each of the protruding faces 62 and the flattened face 65 of the nut 64 have a smaller contact area, so that the nut 64 easily slips during operation.

SUMMARY OF THE INVENTION

The primary objective of the present invention is to provide a hand tool having a larger operation zone to prevent slip of the workpiece.

Another objective of the present invention is to provide a hand tool, wherein each of the protruding faces of the mounting portion has a larger arc-shape, so that each of the protruding faces of the mounting portion is rested on the flattened face of the nut smoothly, thereby preventing the flattened face of the nut from being broken or worn out due to an excessive driving force.

A further objective of the present invention is to provide a hand tool, wherein each of the protruding faces of the mounting portion has a larger arc-shape, so that each of the protruding faces of the mounting portion is closely rested on the flattened face of the nut rigidly and stably so as to prevent slip of the nut.

A further objective of the present invention is to provide a hand tool, wherein by design of the smaller arc-shaped corner of each of the receiving recesses of the mounting portion, the driving stress applied on the mounting portion can be distributed efficiently, thereby preventing the mounting portion from being broken or worn out due to an excessive driving force.

In accordance with the present invention, there is provided a hand tool which comprises a main body provided with a mounting portion including a plurality of arcuate protruding faces and a plurality of receiving recesses located between the protruding faces. Each of the receiving recesses of the mounting portion has an arc-shaped corner. A first distance is defined to be a distance between two walls of each recess.he two wall facing to each other. A second distance is defined to be a distance from a top to a bottom of each arcuate protruding face and a third distance D is defined to be a distance between two ends of a bottom side of the arcuate protruding face. A proportion of the first distance to the second distance is 1:1.6 and a proportion of the third distance to the second distance is 1:1.5.

Further benefits and advantages of the present invention will become apparent after a careful reading of the detailed description with appropriate reference to the accompanying drawings.

DETAILED DESCRIPTION OF THE INVENTION

Figure 1:
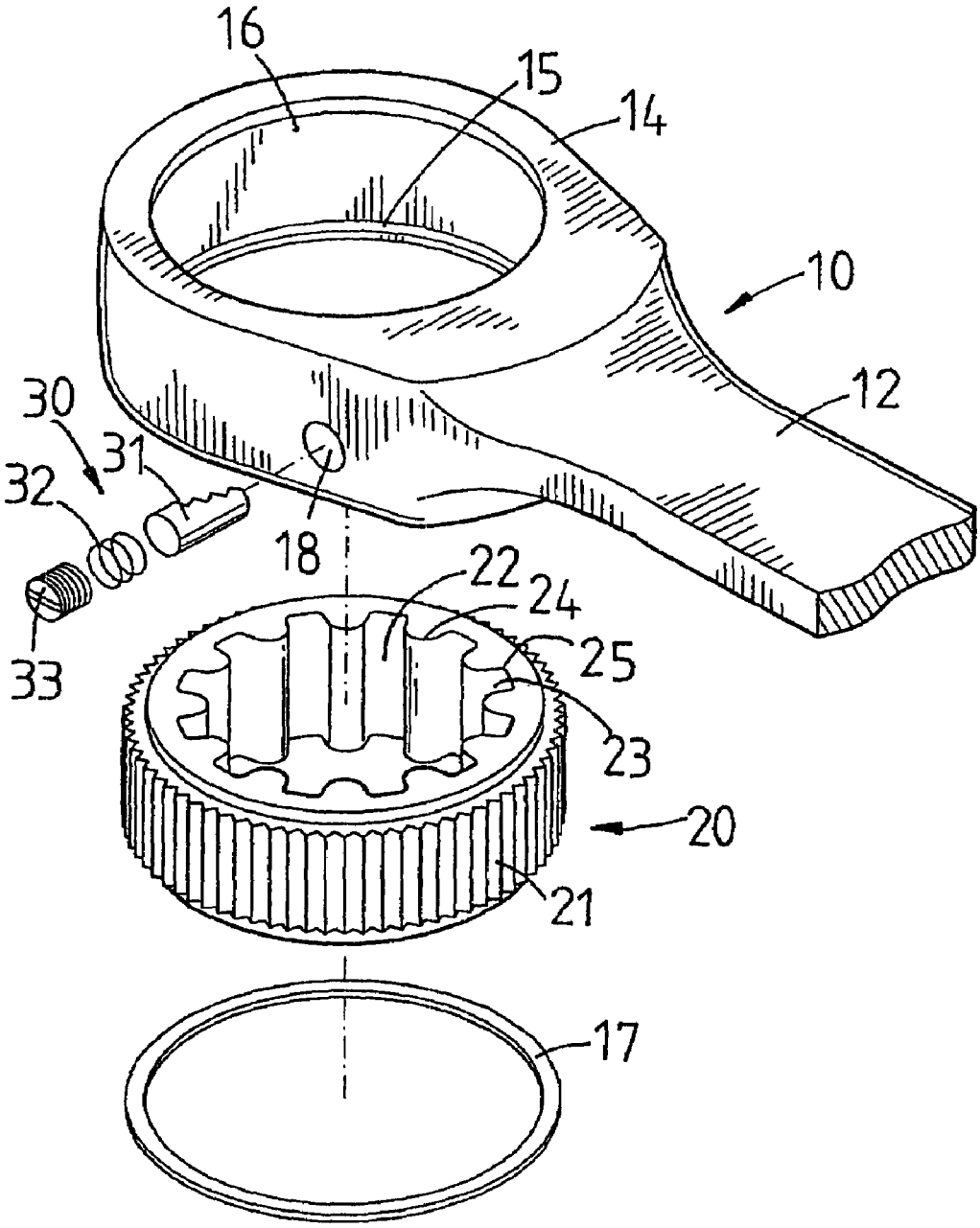
FIG. 1 is a partially cut-away perspective view of a hand tool in accordance with the preferred embodiment of the present invention.
Figure 2:
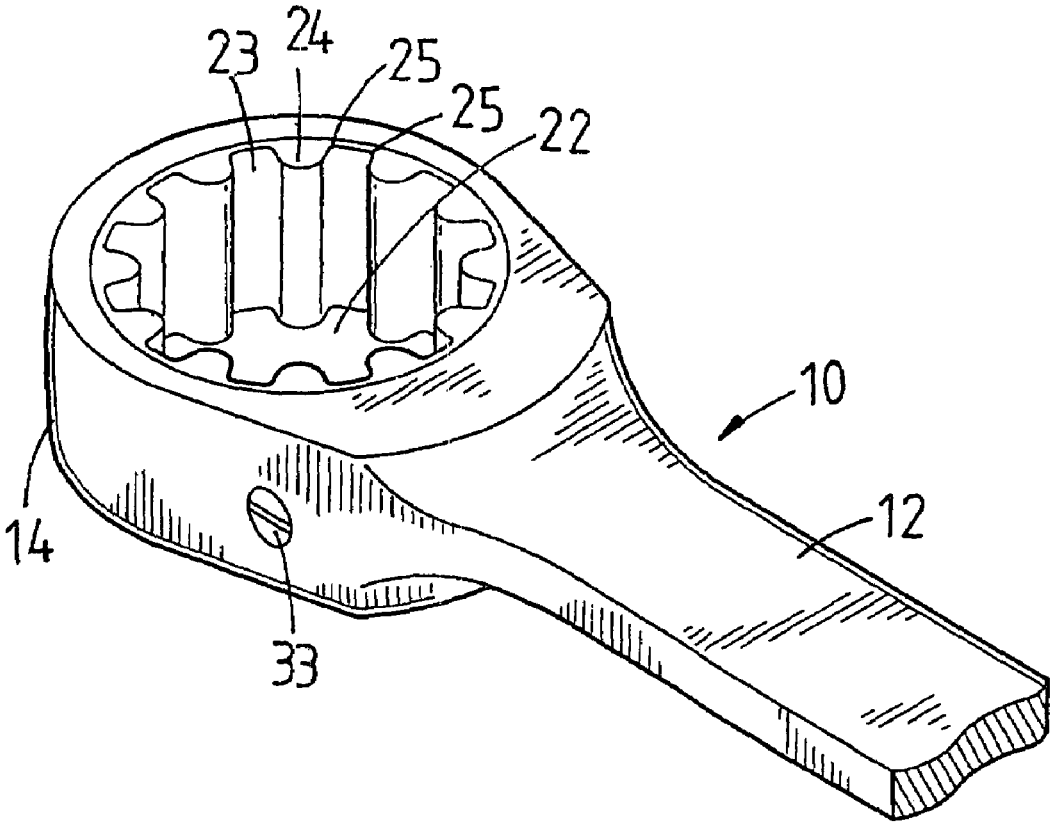
FIG. 2 is an exploded perspective view of the hand tool as shown in FIG. 1.

Referring to the drawings and initially to FIGS. 1-4, a hand tool, such as a wrench, in accordance with the preferred embodiment of the present invention comprises a main body 10, and a ratchet wheel 20 mounted in the main body 10.

The main body 10 includes a handle 12, and a driving head 14 mounted on one end of the handle 12. The driving head 14 of the main body 10 is formed with a receiving space 16 and has a bottom formed with an annular locking portion 15 for locking a snap ring 17. The driving head 14 of the main body 10 has a wall formed with a through hole 18 communicating with the receiving space 16.

The ratchet wheel 20 is mounted in the receiving space 16 of the driving head 14 of the main body 10 and has an outer wall formed with a plurality of ratchet teeth 21.

The hand tool further comprises a locking device 30 mounted in the through hole 18 of the driving head 14 of the main body 10 and including a locking pawl 31 engaged with the ratchet teeth 21 of the ratchet wheel 20, a screw member 33 secured in the through hole 18 of the driving head 14 of the main body 10, and a spring 32 urged between the locking pawl 31 and the screw member 33.

The ratchet wheel 20 has an inner wall formed with a mounting portion 22 for mounting a workpiece, such as a nut 40 (see FIG. 3) or the like. The mounting portion 22 includes a plurality of arcuate protruding faces 24 and a plurality of receiving recesses 23 located between the protruding faces 24. Preferably, the protruding faces 24 of the mounting portion 22 are arranged in an annular manner, and each of the protruding faces 24 of the mounting portion 22 is extended radially inward toward a center of the mounting portion 22. Preferably, the receiving recesses 23 of the mounting portion 22 are arranged in an annular manner, and each of the receiving recesses 23 of the mounting portion 22 is extended radially outward from the center of the mounting portion 22.

Figure 4:
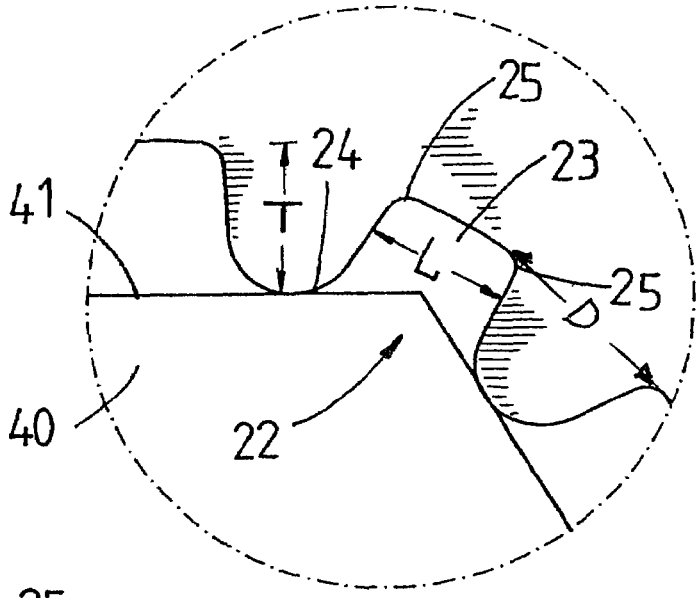
FIG. 4 is a partially enlarged view of the hand tool as shown in FIG. 3.

As shown in FIG. 4, each of the receiving recesses 23 of the mounting portion 22 has two sides each formed with a smaller arc-shaped corner 25. Thus, the smaller arc-shaped corner 25 of each of the receiving recesses 23 of the mounting portion 22 will simplify the milling or casting process of the mounting portion 22. In addition, by design of the smaller arc-shaped corner 25 of each of the receiving recesses 23 of the mounting portion 22, the driving stress applied on the mounting portion 22 can be distributed efficiently, thereby preventing the mounting portion 22 from being broken or worn out due to an excessive driving force.

Figure 3:
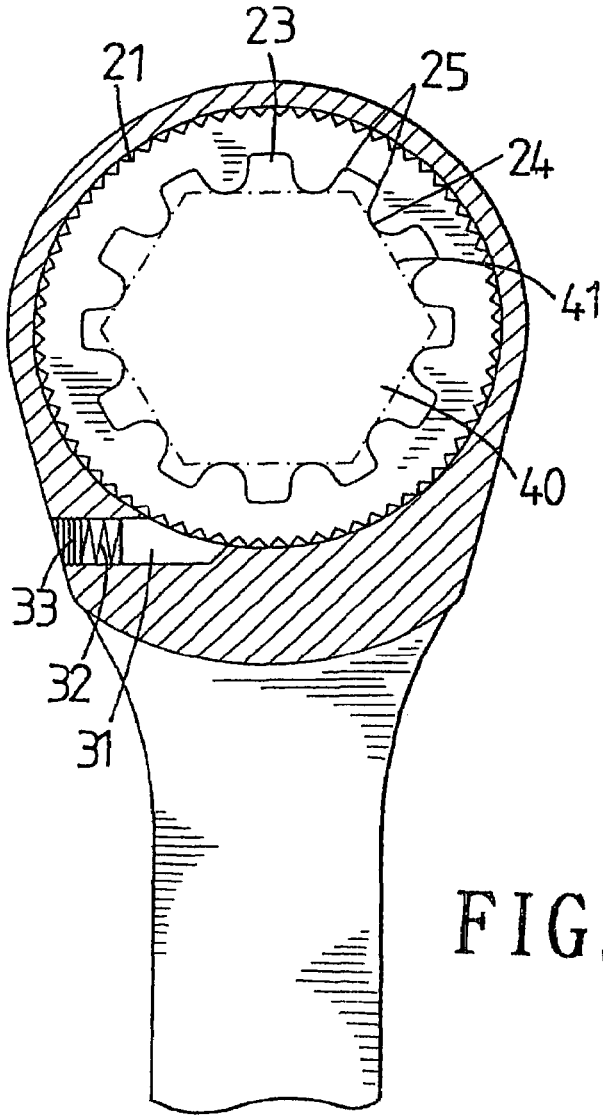
FIG. 3 is a top plan cross-sectional operational view of the hand tool as shown in FIG. 1.

In addition, each of the protruding faces 24 of the mounting portion 22 has a larger arc-shape. In practice, each of the protruding faces 24 of the mounting portion 22 is rested on the flattened face 41 of the nut 40 as shown in FIG. 3 to prevent slip of the nut 40. In such a manner, each of the protruding faces 24 of the mounting portion 22 has a larger arc-shape, so that each of the protruding faces 24 of the mounting portion 22 is closely rested on the flattened face 41 of the nut 40 rigidly and stably so as to prevent slip of the nut 40.

In addition, each of the protruding faces 24 of the mounting portion 22 has a larger arc-shape, so that each of the protruding faces 24 of the mounting portion 22 is rested on the flattened face 41 of the nut 40 smoothly, thereby preventing the flattened face 41 of the nut 40 from being broken or worn out due to an excessive driving force.

In practice. In practice, a first distance L is defined to be a distance between two walls of each recess, where the two wall facing to each other; and a second distance T defined to be a distance from a top to a bottom of each arcuate protruding face. A proportion of the first distance L to the second distance T is 1:1.6, and a third distance D is defined to be a distance between two ends of a bottom side of the arcuate protruding face. A proportion of the third distance to the second distance is 1:1.5. This makes the arcuate protruding face has a bottom wider than the bottom of the recess so that the arcuate protruding face has a concrete structure.

Figure 5:
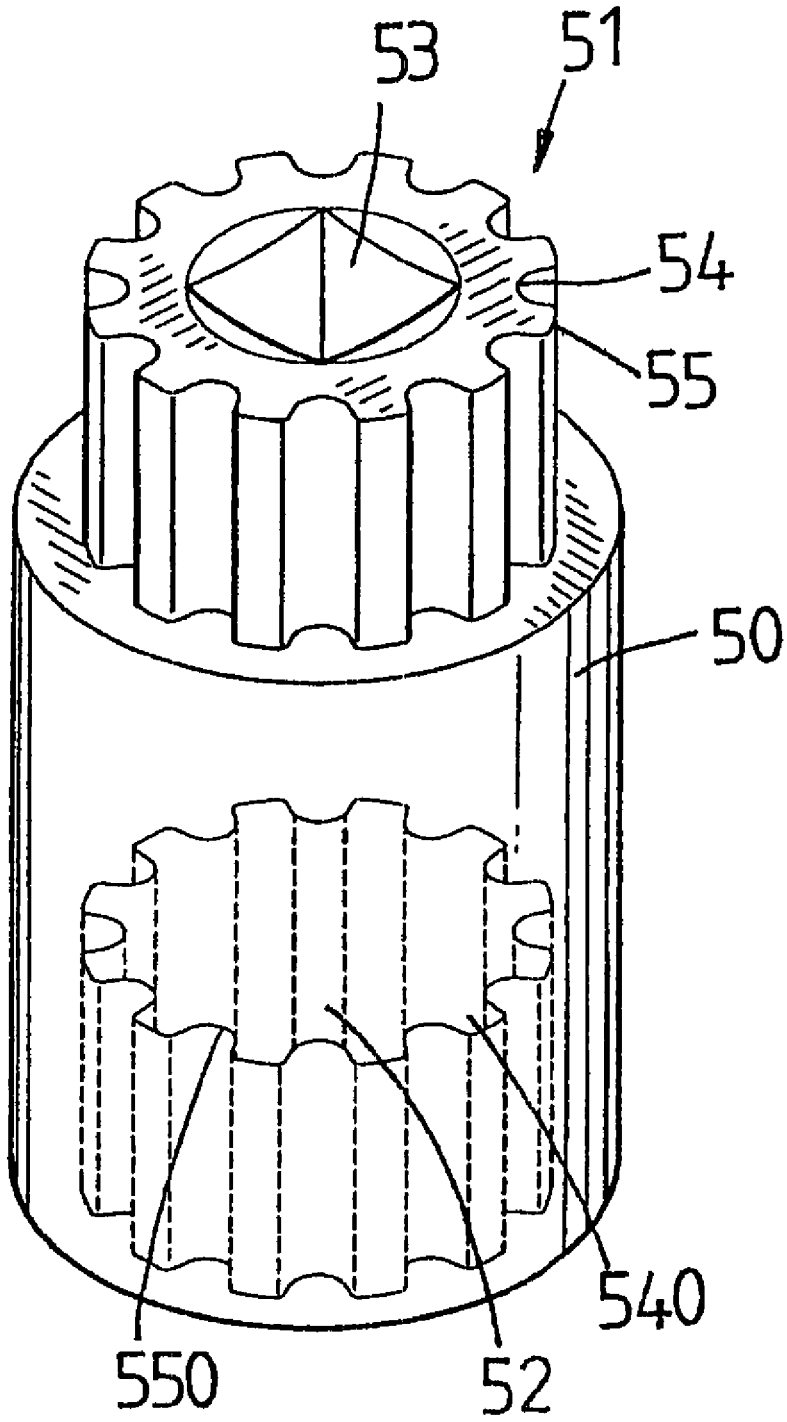
FIG. 5 is a perspective view of a hand tool in accordance with another embodiment of the present invention.
Figure 6:
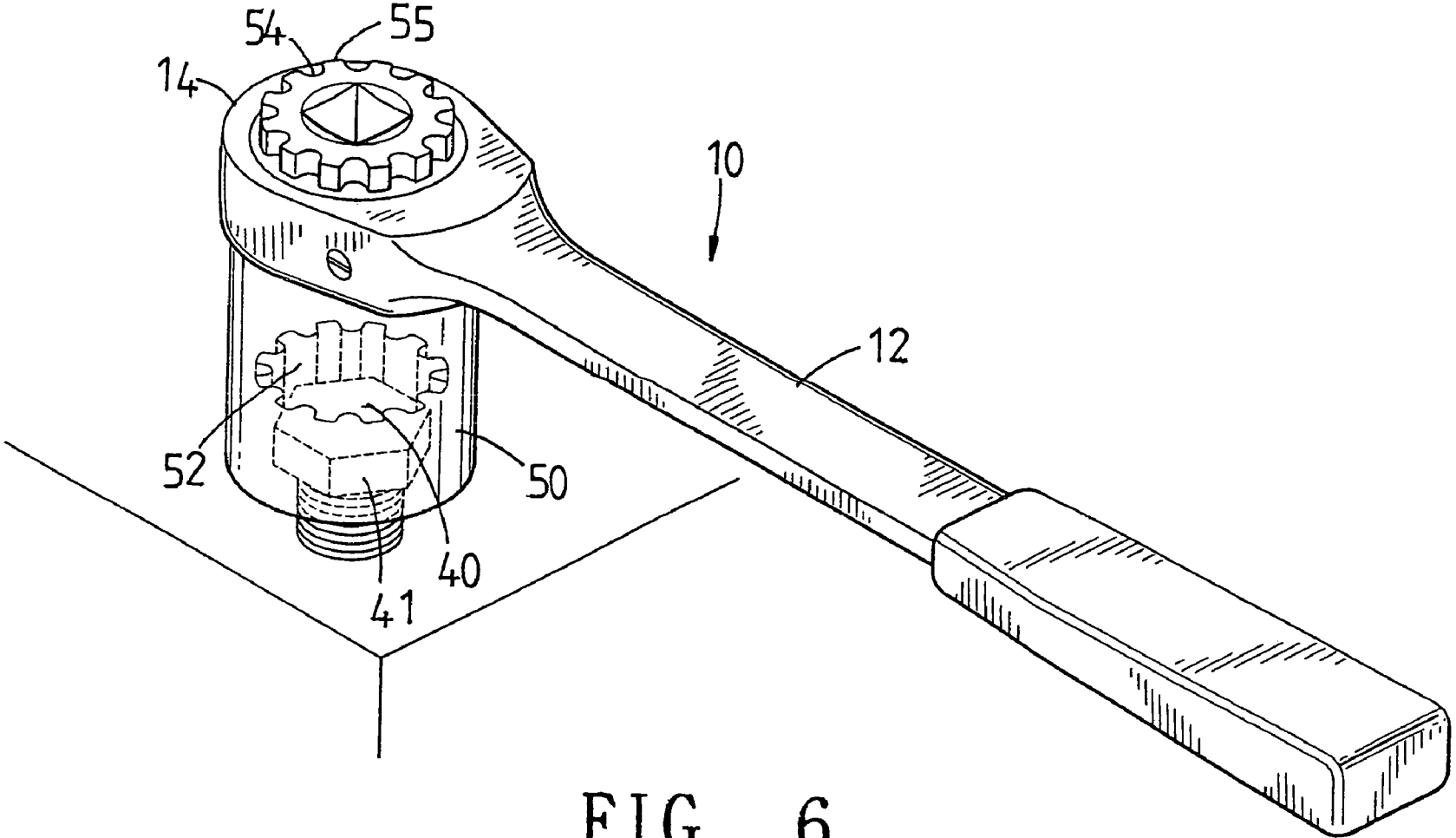
FIG. 6 is a schematic operational view of the hand tool as shown in FIG. 5.

Referring to FIGS. 5 and 6, a hand tool, such as a socket 50, in accordance with another embodiment of the present invention has an upper end formed with a first mounting portion 51 and a lower end having an inner wall formed with a second mounting portion 52. The first mounting portion 51 has a structure the same as that of the mounting portion 22 of the main body 10 of the wrench, and has an inner wall formed with a through hole 53 and an outer wall formed with a plurality of arcuate protruding faces 55 and a plurality of receiving recesses 54 located between the protruding faces 55. The second mounting portion 52 has a structure the same as that of the mounting portion 22 of the main body 10 of the wrench, and includes a plurality of arcuate protruding faces 550 and a plurality of receiving recesses 540 located between the protruding faces 550.

Figure 7:
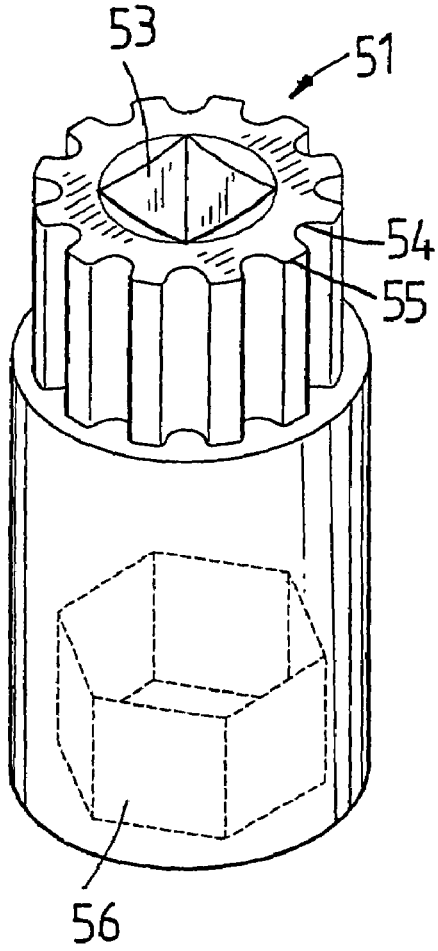
FIG. 7 is a perspective view of a hand tool in accordance with another embodiment of the present invention.
Figure 9:
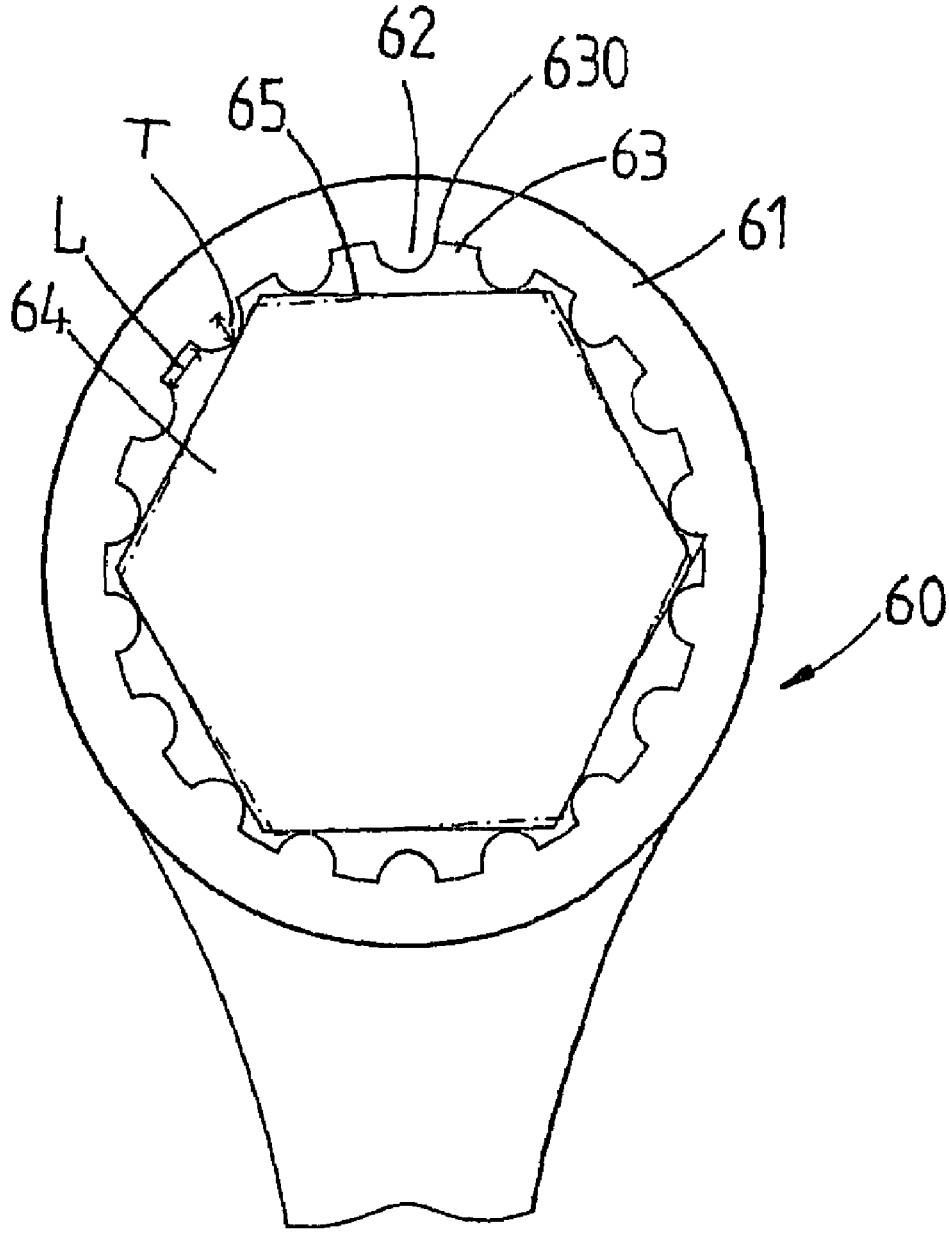
FIG. 9 PRIOR ART
FIG. 9 is a partially cut-away top plan view of a conventional hand tool in accordance with the prior art.

Thus, as shown in FIG. 6, the first mounting portion 51 of the socket 50 is mounted in the mounting portion 22 of the main body 10 of the wrench, and the second mounting portion 52 of the socket 50 is mounted on the nut 40, Referring to FIG. 7, a hand tool, such as a socket 50A, in accordance with another embodiment of the present invention has an upper end formed with the first mounting portion 51 and a lower end having an inner wall formed with a hexagonal recess 57.

Figure 8:
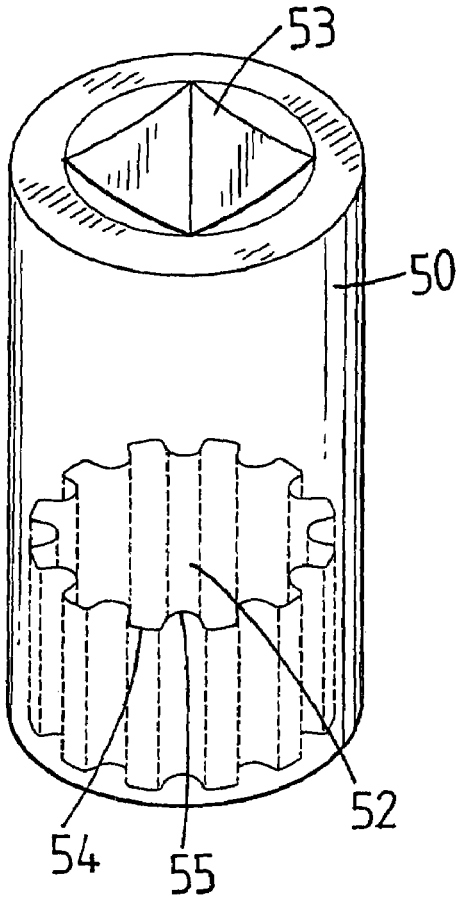
FIG. 8 is a perspective view of a hand tool in accordance with another embodiment of the present invention.

Referring to FIG. 8, a hand tool, such as a socket 50B, in accordance with another embodiment of the present invention has an upper end having an inner wall formed with the through hole 53 and a lower end having an inner wall formed with the second mounting portion 52.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A hand tool, comprising: a main body provided with a mounting portion including a plurality of arcuate protruding faces and a plurality of receiving recesses located between the protruding faces; wherein, each of the receiving recesses of the mounting portion has an arc-shaped corner; a first distance is defined to be a distance between two walls of each recess, where the two wall facing to each other; and a second distance is defined to be a distance from a top to a bottom of each arcuate protruding face; and a third distance D is defined to be a distance between two ends of a bottom side of the arcuate protruding face; then a proportion of the first distance to the second distance is 1:1.6 and a proportion of the third distance to the second distance is 1:1.5;

wherein the protruding faces of the mounting portion are arranged in an annular manner;

wherein each of the protruding faces of the mounting portion is extended radially inward toward a center of the mounting portion;

wherein the receiving recesses of the mounting portion are arranged in an annular manner; and wherein each of the receiving recesses of the mounting portion is extended radially outward from the center of the mounting portion; and each of the protruding faces of the mounting portion has an arc-shape.

2. The hand tool in accordance with claim 1, wherein the main body has a lower end having an inner wall formed with a hexagonal recess.

3. The hand tool in accordance with claim 1, wherein the main body has an upper end having an inner wall formed with a through hole.

* * * * *